US005316305A

United States Patent [19]

McCabe

[11] Patent Number: 5,316,305

[45] Date of Patent: May 31, 1994

[54] GOLF CLUBHEAD WITH MULTI-MATERIAL SOLEPLATE

[75] Inventor: Terrill R. McCabe, West Chester, Ohio

[73] Assignee: Wilson Sporting Goods Co., Chicago, Ill.

[21] Appl. No.: 907,677

[22] Filed: Jul. 2, 1992

[51] Int. Cl.[5] ..... A63B 53/04

[52] U.S. Cl. ..... 273/174; 273/167 A; 273/167 H; 273/171

[58] Field of Search ..... 273/167 R, 167 A, 167 F, 273/169, 171, 172, 173, 174, 167 H

[56] References Cited

U.S. PATENT DOCUMENTS

| | | | |
|---|---|---|---|
| 1,518,316 | 12/1924 | Ellingham | 273/171 |
| 2,163,071 | 6/1939 | Held | 273/171 |
| 3,692,306 | 9/1972 | Glover | 273/171 X |
| 4,052,075 | 10/1977 | Daly | 273/171 |
| 4,313,607 | 2/1982 | Thompson . | |
| 4,319,752 | 3/1982 | Thompson . | |
| 4,591,160 | 5/1986 | Piragino . | |
| 4,602,787 | 7/1986 | Sugioka et al. . | |
| 4,695,054 | 9/1987 | Tunstall . | |
| 4,732,389 | 3/1988 | Kobayashi . | |
| 4,795,159 | 1/1989 | Nagamoto . | |
| 4,803,023 | 2/1989 | Enomoto et al. . | |
| 4,811,949 | 3/1989 | Kobayashi . | |
| 4,824,116 | 4/1989 | Nagamoto et al. . | |
| 4,867,458 | 9/1989 | Sumikawa et al. . | |
| 5,050,879 | 9/1991 | Sun et al. | 273/172 X |
| 5,064,197 | 11/1991 | Eddy . | |

*Primary Examiner*—Vincent Millin
*Assistant Examiner*—Raleigh W. Chiu

[57] ABSTRACT

A metal wood golf clubhead includes a soleplate which is provided with an upwardly extending cavity. An insert of dampening material is positioned in the cavity, and a cover is positioned in the cavity below the insert.

9 Claims, 3 Drawing Sheets

Fig. 1
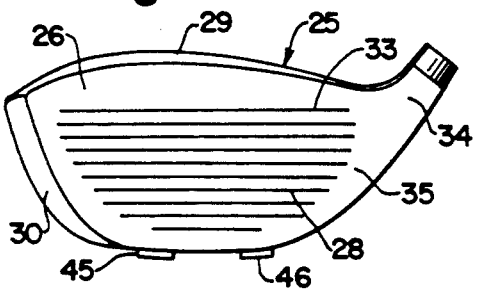
Fig. 2
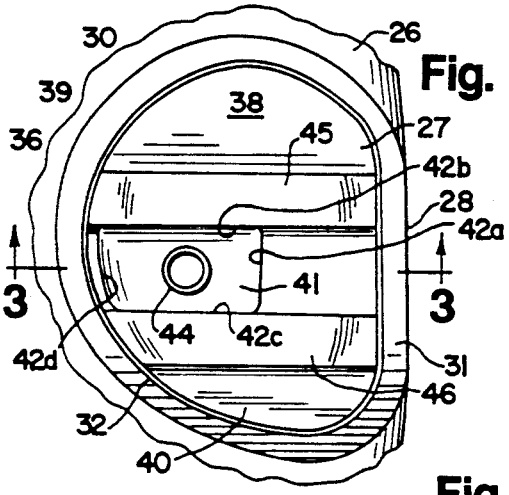
Fig. 3
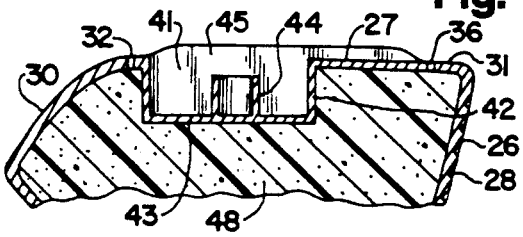
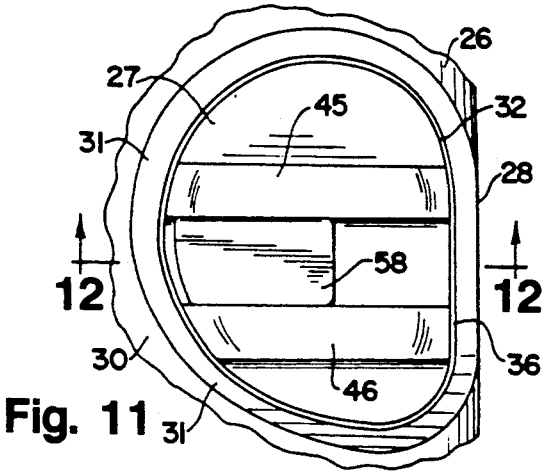
Fig. 11
Fig. 4
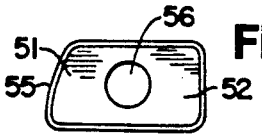
Fig. 5
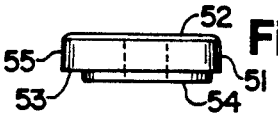
Fig. 6
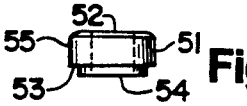
Fig. 7
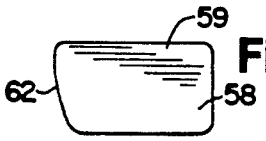
Fig. 8
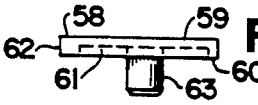
Fig. 9
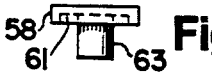
Fig. 10
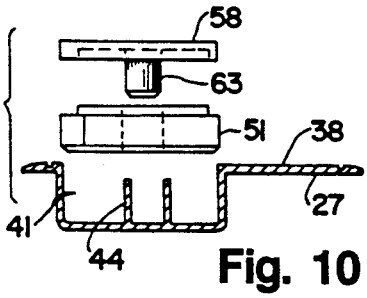
Fig.12
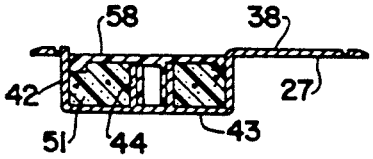

Fig. 13
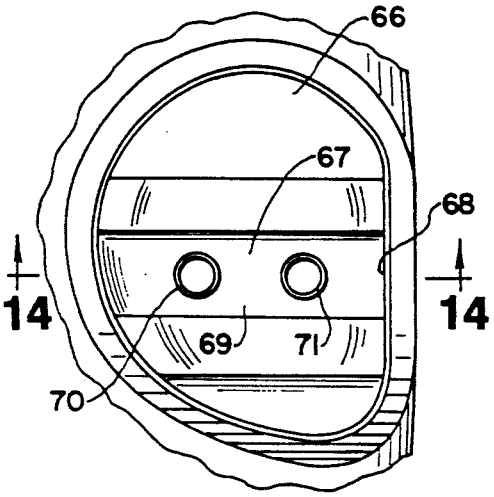
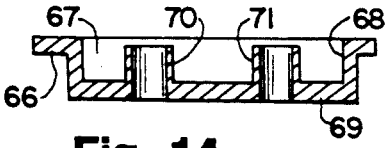
Fig. 14
Fig. 15
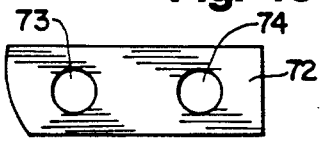
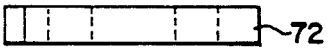
Fig. 16
Fig. 17
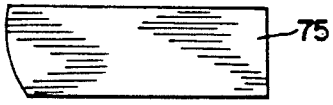
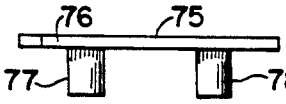
Fig. 18
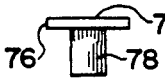
Fig. 19
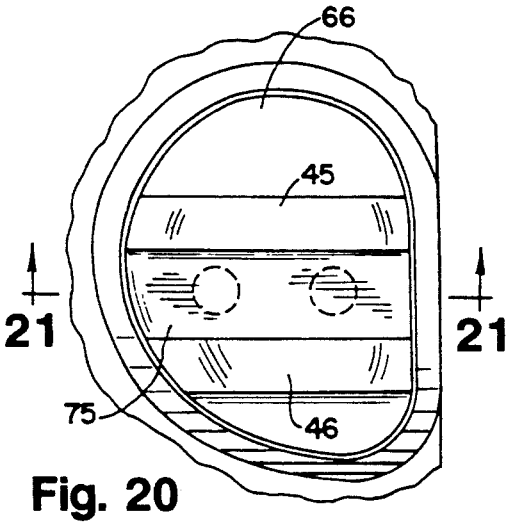
Fig. 20
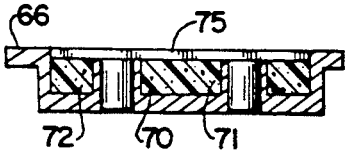
Fig. 21

GOLF CLUBHEAD WITH MULTI-MATERIAL SOLEPLATE

BACKGROUND

This invention relates to golf clubheads, and, more particularly, to a golf clubhead which includes a soleplate with multiple materials for absorbing and dampening impacts and sound.

Wood-type golf clubheads are increasingly being made from non-wood materials such as metal and composite materials, for example, graphite fibers and resin. Wood-type clubheads are those which are commonly referred to as the driver, 2 wood, 3 wood, etc. even though the clubhead is not formed from wood.

A metal wood-type clubhead is conventionally made by investment casting. The head is usually cast in two parts—a hollow shell or body and a soleplate. The shell or body provides the exterior surfaces of the clubhead except for the bottom or sole, which remains open so that the material which forms the interior of the mold can be removed after the body is cast. The soleplate is positioned within the opening of the shell and is suitably secured to the shell, as by welding, to form a hollow clubhead.

The hollow clubhead may be filled with foamed plastic resin, for example, polyurethane. Liquid foamable resin is poured into the clubhead through the opening for the shaft of the club, and the foamable material expands to fill the hollow interior of the clubhead and solidifies. The principal reason for filling the interior of the head is to dampen the undesirable ringing sound of impact which is produced when a hollow metal wood strikes a golf ball. However, even when metal clubheads are filled with foamed plastic, metal woods, particularly drivers, still tend to produce an undesirable ringing or ping sound upon impact.

SUMMARY OF THE INVENTION

The invention provides a unique soleplate for a metal wood which incorporates a multi-material dampening concept. The soleplate is provided with a cavity in which dampening material is positioned, and the cavity is closed by a cover. The dampening material and the cover act as a shock absorber to help dissipate the shock and ringing sound of impact, thereby improving the sound and feel of the club.

DESCRIPTION OF THE DRAWING

The invention will be explained in conjunction with an illustrative embodiment shown in the accompanying drawing, in which.

FIG. 1 is a front elevational view of a clubhead having a soleplate which is equipped with a multi-material dampener in accordance with the invention;

FIG. 2 is a fragmentary bottom plan view of the clubhead;

FIG. 3 is a fragmentary sectional view taken along the line 3—3 of FIG. 2;

FIG. 4 is a top plan view of the dampener insert;

FIG. 5 is a side elevational view of the dampener insert;

FIG. 6 is an end elevational view of the dampener insert;

FIG. 7 is a bottom plan view of the cover;

FIG. 8 is a side elevational view of the cover;

FIG. 9 is an end elevational view of the cover;

FIG. 10 is an exploded sectional view of the soleplate, dampener insert, and cover;

FIG. 11 is a fragmentary bottom plan view of the assembled soleplate;

FIG. 12 is a sectional view of the assembled soleplate and dampener and cover;

FIG. 13 is a view similar to FIG. 2 showing a modified soleplate;

FIG. 14 is a fragmentary sectional view taken along the line 14—14 of FIG. 13;

FIG. 15 is a bottom plan view of the dampener insert for the soleplate of FIG. 13;

FIG. 16 is a side elevational view of the dampener insert;

FIG. 17 is a bottom plan view of the cover for the soleplate of FIG. 13;

FIG. 18 is a side elevational view of the cover;

FIG. 19 is an end elevational view of the cover;

FIG. 20 is a view similar to FIG. 13 showing the assembled soleplate and dampener and cover;

FIG. 21 is a fragmentary sectional view taken along the line 21—21 of FIG. 20.

DESCRIPTION OF SPECIFIC EMBODIMENT

Figure 22:
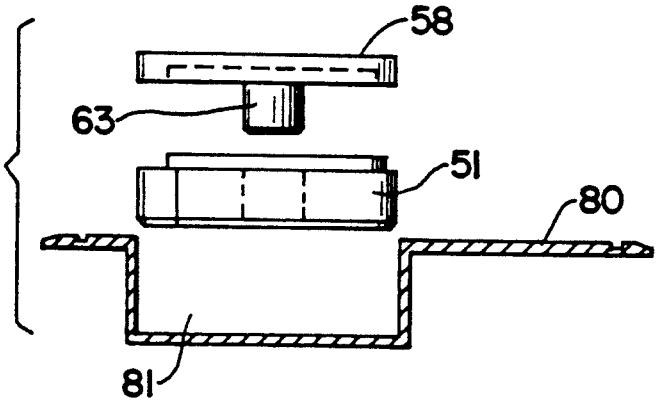
FIGS. 22-24 are exploded sectional views of additional embodiments of the soleplate.

Referring to FIGS. 1-3, a metal wood-type clubhead 25 includes a body 26 and a soleplate 27 which forms the bottom of the clubhead. The particular clubhead illustrated is a driver, but the invention can be used with other types of clubheads.

The body 26 is investment cast in the conventional manner from conventional material, for example, stainless steel. The body includes a front face 28 which strikes the golf ball, a top wall 29 which extends rearwardly from the face, and a side wall 30 which extends downwardly from the top wall and rearwardly from the face. A bottom rim 31 extends inwardly from the side wall 30 and terminates in a generally circular edge 32. The front face is cast with conventional grooves 33. A tubular hosel or neck 34 extends angularly upwardly from the heel portion 35 of the body.

The thickness of the face 28 is typically between about 0.110 to 0.130 inch, and the thickness of the remainder of the hollow head is typically between about 0.025 to 0.040 inch except for the area where the hosel joins the heel, which may be reinforced by additional material.

The soleplate 27 is sized to fit into the opening formed by the edge 32 of the bottom rim 31 of the body. The soleplate is secured to the body by a peripheral weld 36 (FIG. 3) between the edge of the soleplate and the edge 32. The weld is thereafter ground to provide a smooth, unnoticeable junction between the soleplate and the body.

The soleplate 27 includes a generally flat main portion 38 which includes a toe portion 39 and a heel portion 40. An upwardly extending cavity 41 is formed in the back central portion of the soleplate. In the particular embodiment illustrated the cavity is generally rectangular and is defined by a generally rectangular side wall 42 which extends upwardly, i.e., toward the top wall 29 of the body, and a top wall 43. The side wall includes a front portion **42*a*, toe and heel portions 42*b* and 42*c*, and a rear portion 42*d*. The top wall 43 extends generally parallel to the main portion 38 of the soleplate. A tubular projection 44 extends downwardly from the center of the top wall 43**.

The soleplate may also be investment cast from stainless steel, and the main portion 38, cavity walls 42 and 43, and projection 44 are integrally formed. The thickness of the main portion 38 and the cavity walls 42 and 43 can be about 0.045 to 0.055 inch. The particular soleplate illustrated also includes a pair of downwardly extending, generally parallel rails 45 and 46 which extend below the front face 28 of the clubhead (see FIG. 1). The soleplate can also be cast without the rails.

After the soleplate is attached to the body, the interior of the clubhead is filled with foamed plastic 48 (FIG. 3). Conventional liquid foaming material is poured into the interior of the clubhead through the hosel 34. The liquid foaming material foams and expands to fill the interior of the clubhead and then hardens or solidifies.

Referring to FIGS. 4–6, a dampening insert 51 is sized to fit into the cavity 41. The insert is formed from shock and sound dampening material, for example, soft, semi-gel polyurethane, EVA (ethylene vinyl acetate) and other thermoplastic materials which have a Shore hardness within the range of the Shore A and low Shore B scale. Synthetic rubber and silicone have also been used. The fundamental criteria are that the material needs to be soft and have dampening characteristics.

The insert includes a flat top surface 52, a flat bottom rim 53, and a rectangular projection 54 which extends below the bottom rim 53. A side wall 55 is shaped to fit inside of the side wall 42 of the cavity. A central opening 56 extends through the insert so that the insert can be inserted over the cylindrical projection 44 in the cavity.

Referring to FIGS. 7–9, a cover 58 is sized to be inserted into the cavity 41 below the insert 51. The cover is preferably formed from hard plastic material such as Lexan 3412 which is 20% glass filled. Other suitable materials include Butyrate and glass or graphite filled ABS. While a lightweight material is desirable, the cover could also be formed from light or heavy metal. The cover includes a flat bottom surface 59, a top wall 60, and a recess 61 in the top wall which is shaped and sized to accommodate the projection 54 on the insert. A side wall 62 is shaped to fit inside of the side wall 42 of the cavity. A cylindrical post 63 extends upwardly from the central portion of the cover and is sized to be inserted into the tubular projection 44 in the cavity.

As shown in FIGS. 10–12, the insert 51 is inserted into the cavity 41 so that the projection 44 extends through the opening 56 in the insert. If desired, the insert may be secured to one or more walls of the cavity by adhesive, for example, epoxy adhesive. The cover 58 is then positioned in the cavity below the insert by inserting the post 63 into the projection 44. The post is sized to provide a friction fit in the projection, and the cover may also be secured by epoxy adhesive. When the cover is positioned in the recess, the bottom surface 59 is substantially flush with the bottom surface of the main portion 38 of the soleplate.

The club is completed by inserting a conventional shaft into the hosel 34 and securing the shaft to the clubhead.

In one specific embodiment of the invention, the length of the insert 51 was 1.125 inch, the width was 0.625 inch, the thickness between the top wall 52 and the bottom rim 53 was 0.2495 inch, and the thickness of the projection 54 was 0.0625 inch. The length and width of the projection 54 was 0.0625 and 0.500 inch, respectively. The diameter of the opening 56 was 0.312 inch. The length and width of the cover 58 and of the recess 61 in the cover corresponded to the length and width of the insert 51 and its projection 54. The thickness of the cover between the bottom surface 59 and the top rim 60 was 0.125 inch. The diameter of the post 63 was 0.250 inch.

A modified soleplate 66 is illustrated in FIGS. 13–21.

A cavity 67 extends across substantially the entire front-to-rear dimension of the soleplate and is defined by a side wall 68 and a top wall 69. A pair of tubular projections 70 and 71 extend downwardly from the top wall 69. A polyurethane insert 72 is shaped to be inserted into the cavity and is provided with two openings 73 and 74 for the projections 70 and 71. A plastic cover 75 includes a flat bottom plate 76 and a pair of cylindrical posts 77 and 78 which are sized to be inserted into the projections 70 and 71. FIGS. 20 and 21 illustrate the assembled soleplate.

The hard plastic covers 58 and 75 not only protect the inserts 51 and 72 from wear, but the covers cooperate with the inserts to form a multi-material dampener. The insert and the cover, both individually and in combination, absorb and dampen the shock and sound of impact when the clubhead strikes a golf ball. The sound and feel of impact are both improved compared to a soleplate without the insert and cover.

FIG. 22 illustrates a soleplate 80 which is similar to the soleplate of FIG. 10 except that it does not have the tubular projection 44. A dampening insert 51 is inserted into a cavity 81, and a cover 58 with a projection 63 is positioned over the insert. The insert and cover can be adhesively secured to the soleplate.

Figure 23:
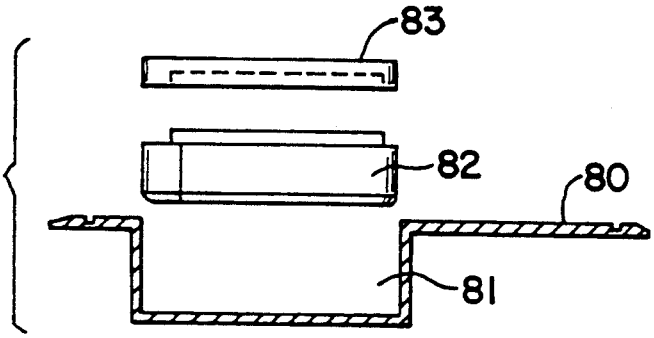

FIG. 23 illustrates a modification of the embodiment of FIG. 22. An insert 82 is similar to the insert 51 except that it does not have the central opening 56. Cover 83 is similar to the cover 58 except that it does not have the projection 63. The insert 82 is adhesively secured within the cavity 81 of the soleplate 80, and the cover 83 is adhesively secured to the insert.

Figure 24:
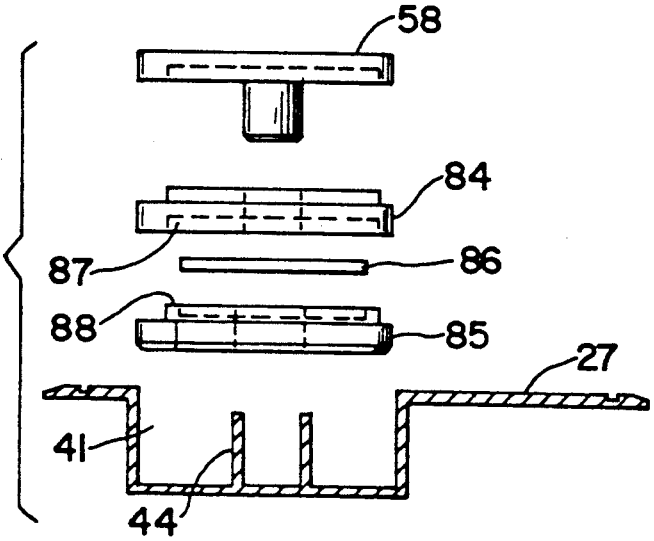

FIG. 24 illustrates still another embodiment of the invention. The soleplate 27 and cover 58 are the same as the soleplate and cover of FIG. 10. A pair of dampening inserts 84 and 85 are inserted into the cavity 41 over the projection 44, and heavy metal wafer 86 is sandwiched between the inserts. The metal wafer is inserted into a recess 87 in the lower insert 84, and a projection 88 on the upper insert 85 abuts the wafer.

Although I have described the insert and cavity in conjunction with a metal clubhead, the invention can also be used with clubheads formed from other materials such as composite materials. Composite materials include fibers of graphite, Kevlar, etc. in a resin matrix.

While in the foregoing specification, a detailed description of specific embodiments of the invention have been set forth for the purpose of illustration, it will be understood that many of the details herein given may be varied considerably by those skilled in the art without departing from the spirit and scope of the invention.

I claim:

1. A wood-type golf clubhead having a sole, a front face, a top wall which extends rearwardly from the face, and a side wall which extends between the top wall and the sole, the sole having a cavity formed therein which is formed by a side wall which extends upwardly from the sole and a top wall, a projection extending downwardly from the top wall of the cavity, an insert of dampening material positioned in the cavity and surrounding the projection, and a cover attached to the projection below the insert.

2. The clubhead of claim 1 in which the projection is tubular and the cover includes a post which extends into the projection.

3. The clubhead of claim 1 in which the sole, side wall of the cavity, top wall of the cavity, and the projection are integral.

4. The clubhead of claim 3 in which the cover is formed from plastic.

5. A metal wood golf clubhead comprising a thin-walled metal body having a sole, a front face, a top wall which extends rearwardly from the face, and a side wall which extends between the top wall and the sole, the sole having a cavity formed therein, a polyurethane insert of dampening material positioned in the cavity, and a plastic cover which extends over the insert in the cavity.

6. A metal wood golf clubhead comprising a thin-walled metal body having a sole, a front face, a top wall which extends rearwardly from the face, and a side wall which extends between the top wall and the sole, the sole having a cavity formed therein, an EVA insert of dampening material positioned in the cavity, and a plastic cover which extends over the insert in the cavity.

7. A metal wood golf clubhead comprising a thin-walled metal body having a sole including a soleplate, a front face, a top wall which extends rearwardly from the face, and a side wall which extends between the top wall and the sole, the soleplate having a cavity formed therein, the cavity being formed by a side wall which extends upwardly from the soleplate and a top wall, the soleplate, side wall of the cavity, and top wall of the cavity being investment cast in a single piece of metal, and an insert of dampening material positioned in the cavity.

8. The clubhead of claim 7 in which the insert is formed from material selected from the group of dampening material consisting of polyurethane, EVA, rubber, and silicone.

9. The clubhead of claim 7 in which a cover is positioned in the cavity below the insert.

* * * * *